US007896453B2

(12) United States Patent
Oda

(10) Patent No.: US 7,896,453 B2
(45) Date of Patent: Mar. 1, 2011

(54) RECORDING APPARATUS

(75) Inventor: Naoki Oda, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 798 days.

(21) Appl. No.: 11/692,387

(22) Filed: Mar. 28, 2007

(65) Prior Publication Data

US 2007/0229564 A1 Oct. 4, 2007

(30) Foreign Application Priority Data

Mar. 30, 2006 (JP) ..... 2006-093903

(51) Int. Cl.
*B41J 29/38* (2006.01)
*B41J 29/393* (2006.01)

(52) U.S. Cl. ..... 347/5; 347/17; 347/19

(58) Field of Classification Search ..... 347/5, 347/14, 17, 19
See application file for complete search history.

(56) References Cited

U.S. PATENT DOCUMENTS 6,652,057 B2 * 11/2003 Masuda et al. ..... 347/14
7,559,626 B2 * 7/2009 Sakurai et al. ..... 347/50
2004/0135831 A1 * 7/2004 Usuda et al. ..... 347/10

FOREIGN PATENT DOCUMENTS

JP 2004-080890 A 3/2004

* cited by examiner

*Primary Examiner*—Julian D Huffman
*Assistant Examiner*—Jason S Uhlenhake
(74) *Attorney, Agent, or Firm*—Banner & Witcoff, Ltd.

(57) ABSTRACT

A recording apparatus includes a head that discharges ink and a head driving circuit that generates a switching signal. The recording apparatus further includes a switching signal generating unit that generates and outputs a switching signal, a first switch that is turned on or off based on the switching signal and a second switch that is turned on or off based on the switching signal. A first DC voltage is converted into a second DC voltage by switching one of the first switch and the second switch based on the switching signal, and the second DC voltage is supplied to the head driving circuit. The first switch and the second switch may be turned on or off based on the detected temperature of the head or ink in the head.

9 Claims, 4 Drawing Sheets

RECORDING APPARATUS

CROSS REFERENCE TO RELATED APPLICATION

This application claims priority from Japanese Patent Application No. 2006-093903, filed on Mar. 30, 2006, the entire subject matter of which is incorporated herein by reference.

FIELD

Aspects of the present invention relate to a recording apparatus, and more particularly to a recording apparatus provided with a DC/DC converter.

BACKGROUND

In the related art recording apparatuses for discharging ink from a recording head driven by a head driving circuit to record an image on a recording medium have been known. The recording apparatus is provided with a DC/DC converter that converts a DC voltage input from a main power supply into another DC voltage and outputs the converted another DC voltage to the head driving circuit as a power supply.

In addition, a DC/DC converter including an FET (field effect transistor), a temperature sensor provided around the FET, and a temperature monitoring circuit that outputs a signal for stopping a control operation of the FET in response to an output from the temperature sensor when the temperature sensor detects an abnormal increase in temperature has been known.

However, in the above-mentioned technique, when the temperature of the FET becomes greater than a predetermined temperature representing an abnormal temperature-increasing state, the control operation of the FET stops. Therefore, it is possible to control an increase in the temperature of the FET. However, in this case, the operational range of the DC/DC converter is narrowed. Thus, an increase in the driving efficiency of the DC/DC converter is needed.

SUMMARY

One aspect of the invention may provide a recording apparatus including a head that discharges ink; a head driving circuit that drives the head; a switching signal generating unit that generates and outputs a switching signal; a first switch that is turned on or off based on the switching signal; and a second switch that is turned on or off based on the switching signal. A first DC voltage is converted into a second DC voltage by switching between the first switch and the second switch, and the second DC voltage is supplied to the head driving circuit. The recording apparatus further includes a temperature detector that detects a temperature of the head or ink of the head; and a controller that controls the switching signal generating unit to generate the switching signal. The controller controls the switching signal generating unit to output the switching signal to the first switch when the detected temperature is less than a first predetermined temperature and to output the switching signal to the second switch when the detected temperature is equal to or greater than the first predetermined temperature.

Another aspect of the invention may provide a recording apparatus including a head that discharges ink; a head driving circuit that drives the head; a switching signal generating unit that generates a switching signal; a first switch that is turned on or off based on the switching signal; and a second switch that is turned on or off based on the switching signal. A first DC voltage is converted into a second DC voltage by switching between the first switch and the second switch, and the second DC voltage is supplied to the head driving circuit. The recording apparatus further includes a temperature detector that detects a temperature of the ink; a voltage detector that detects the second DC voltage and a controller that controls the switching signal generating unit to generate the switching signal. The controller controls the switching signal generating unit to output the switching signal to the first switch when the detected ink temperature is greater than or equal to a predetermined temperature, and if the ink temperature is less than the predetermined temperature the controller controls the switching signal generating unit to output the switching signal to the second switch when the detected second DC voltage is less than the predetermined voltage and to output the switching signal to the first switch when the detected second DC voltage is equal to or greater than the predetermined voltage.

In a further aspect, a recording apparatus may be provided including a head that discharges ink, a head driving circuit that drives the head, a switching signal generating unit that generates and outputs a switching signal, a first switch that is turned on or off based on the switching signal, and a second switch that is turned on or off based on the switching signal. A first DC voltage may be converted into a second DC voltage by switching one of the first switch and the second switch based on the switching signal, and the second DC voltage can be supplied to the head driving circuit. The recording apparatus further includes a voltage detector that detects the second DC voltage, and a controller that controls the switching signal generating unit to generate the switching signal to output the switching signal to the first switch when the detected second DC voltage is less than a predetermined voltage and to output the switching signal to the second switch when the detected second DC voltage is equal to or greater than the predetermined voltage.

In another aspect, a method for controlling discharge of ink from a head in a recording apparatus including detecting temperature of the head or ink in the head, generating a first switching signal when the detected temperature is less than a first predetermined temperature, and generating a second switching signal when the detected temperature is equal to or greater than the first predetermined temperature. Also, the method includes converting a first DC voltage into a second DC voltage in response to the generation of one of the first switching signal and the second switching signal, and supplying the second DC voltage to drive a head driving circuit which drives the head to discharge ink.

DETAILED DESCRIPTION

Figure 1:
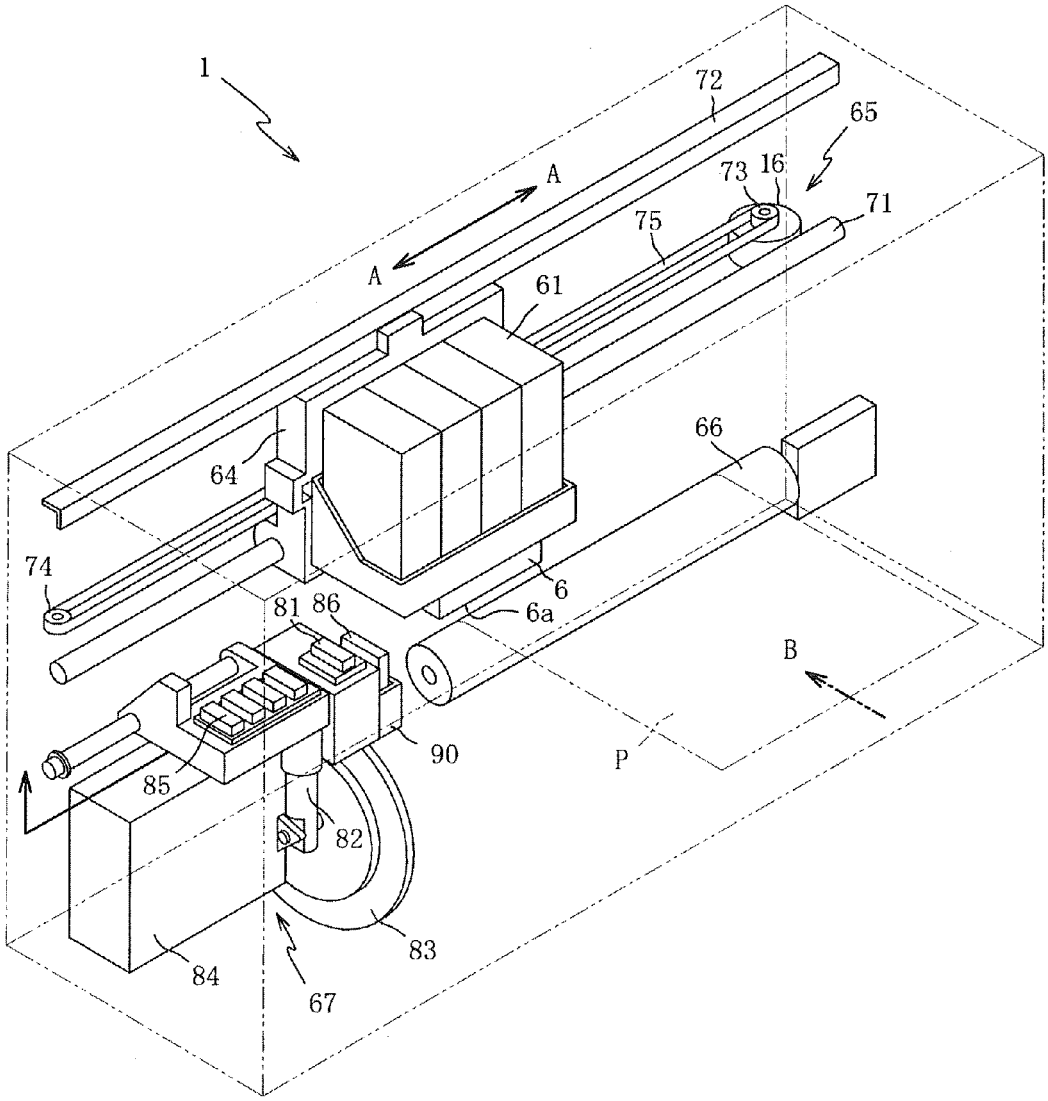
FIG. 1 is a perspective view illustrating a color ink jet printer, which is a recording apparatus according to aspects of the invention.
Figure 2:
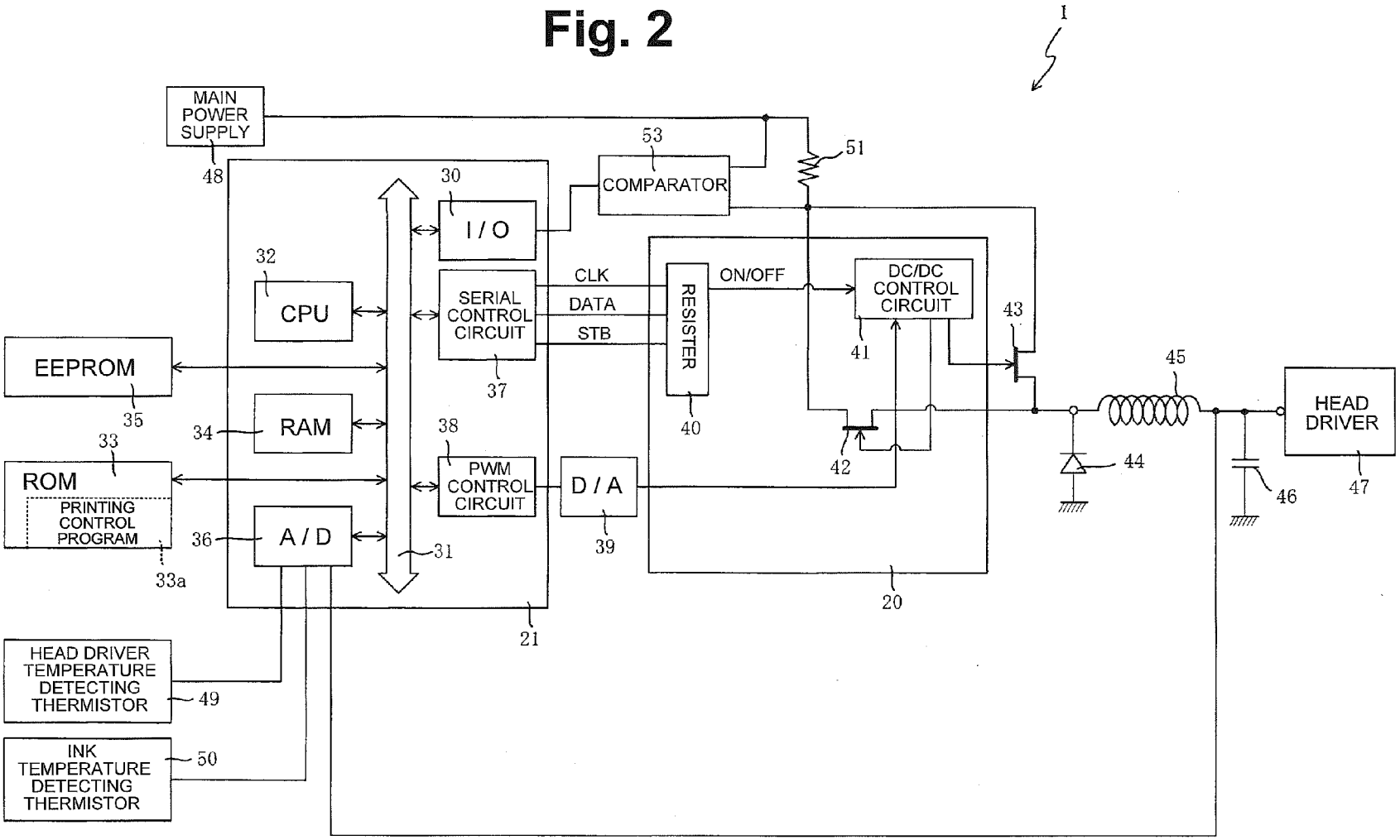
FIG. 2 is a block diagram schematically illustrating the electric circuit structure of the color ink jet printer.

Hereinafter, exemplary aspects of the invention will be described with reference to the accompanying drawings. FIG. 1 is a perspective view illustrating a color ink jet printer 1 serving as a recording apparatus according to illustrative of the invention. FIG. 2 is a block diagram schematically illustrating the electric circuit structure of the color ink jet printer. The color ink jet printer 1 includes, for example, four color ink cartridges 61 having cyan (C), magenta (M), yellow (Y), and black (Bk) ink contained therein, an ink jet head 6 for printing an image on a recording sheet P, a carriage 64 having the ink cartridges 61 and the ink jet head 6 mounted thereon, a driving unit 65 that moves the carriage 64 in the direction of arrow A (main scanning direction), a support member 66 that is provided so as to extend in the direction A in which the carriage 64 is moved and to be opposite to the ink jet head 6, and a purge device 67 configured to clear the ink jet head 6 under certain predetermined conditions such as when ink blocks the ink jet head 6.

The driving unit 65 includes a carriage shaft 71 that is provided below the carriage 64 so as to extend in parallel to the support member 66, a guide plate 72 that is provided above the carriage 64 so as to extend in parallel to the carriage shaft 71, two pulleys 73 and 74 that are provided at both sides of the carriage shaft 71 between the carriage shaft 71 and the guide plate 72, an endless belt 75 that is wound around the two pulleys 73 and 74. When one pulley 73 rotates in the forward or reverse direction by the driving of a carriage (CR) motor 16, the rotation of the pulley 73 in the forward or reverse direction causes the carriage 64 connected to the endless belt 75 to move in the direction of arrow A, which is the main scanning direction, along the carriage shaft 71 and the guide plate 72.

Nozzles (not shown) corresponding to four color inks, that is, C, M, Y, and Bk inks, are provided on the lower surface 6*a* of the ink jet head 6 in a direction B in which the recording sheet P is carried (sub-scanning direction B). In addition, the number of nozzles and the pitch among the nozzles in the arrangement direction depend on, for example, the resolution of an image to be printed. Further, the number of rows of nozzles may increase or decrease according to the number of types of color ink.

The recording sheet P is fed from a sheet feeding cassette (not shown) of the color ink jet printer 1 and is then carried by a feed roller (not shown) in the direction of arrow B (sub-scanning direction which is orthogonal to the main scanning direction A) between the lower surface 6*a* of the ink jet head 6 and the support member 66. Then, ink is discharged from the nozzles onto the recording sheet P to have an image printed thereon, and is then discharged from the ink jet printer 1. In FIG. 1, mechanisms for feeding and discharging the recording sheet P are not shown.

The purge device 67 for cleaning the ink jet head 6 having an ink discharge failure is provided on the side of the support member 66 in the direction in which the carriage 64 moves. The ink discharge failure of the ink jet head 6 occurs due to, for example, bubbles in ink or an increase in the viscosity of the ink. The purge device 67 is provided to clean the ink jet head 6 and return the ink jet head 6 from an ink discharge failure state to a normal ink discharge state.

The purge device 67 is provided so as to face the ink jet head 6 when a head unit 63 is disposed at a purge position at which it may be cleaned, and includes a cap 81, a pump 82, a cam 83, and an ink containing portion 84. The cap 81 closely adheres to the bottom surface 6*a* of the ink jet head 6, and then the pump 82 sucks defective ink, such as ink having bubbles, from the inside of the ink jet head 6. The cam 83 of the pump 82 rotates to move a piston in the pump 82, thereby sucking the defective ink from the ink jet head 6. The suction of defective ink causes the ink discharge failure of the ink jet head 6 to be cleaned and repaired. The defective ink sucked out of the ink jet head 6 is put in the ink containing portion 84.

A wiper member 86 capable of moving relative to the ink jet head 6 is provided on one side of the purge cap 81 facing the support member 66, and a cap 85 is provided opposite to the wiper member 86 with the purge cap interposed therebetween. The wiper member 86 is formed of an elastic material, such as ethylene propylene rubber, in a plate shape, and one end of the wiper member 86 is inserted into a wiper holder 90, so that the wiper member 86 is supported by the wiper holder 90. The wiper member 86 is provided so as to protrude toward the ink jet head 6, and wipe out ink remaining on the lower surface 6*a* of the ink jet head 6 by the movement of the carriage 64. The cap 85 covers the nozzles formed in the ink jet head 6 to prevent the evaporation of ink.

Next, the electric circuit structure of the color ink jet printer 1 will be described with reference to FIG. 2. FIG. 2 is a block diagram schematically illustrating the electric circuit structure of the color ink jet printer 1.

The color ink jet printer 1 includes an ASIC 21 and a complex IC 20. The ASIC 21 is provided with a input/output (I/O) port 30, CPU 32, which is a one-chip arithmetic device, a RAM 34, an A/D converter 36, a serial control circuit 37 that generates serial signals, and a PWM control circuit 38 that generates PWM signals. These components are connected to one another through a bus line 31. In addition, an EEPROM 35 and a ROM 33 having various control programs and fixed value data stored therein are connected to the bus line 31.

The CPU 32 generates a printing timing signal and a reset signal according to a control program previously stored in the ROM 33. The generated signals are serially transmitted through the serial control circuit 37. A head driver temperature detecting thermistor 49 and an ink temperature detecting thermistor 50, and an output terminal of an inductor 45 are connected to the A/D converter 36. The head driver temperature detecting thermistor 49 detects the temperature of a head driver 47. The ink temperature detecting thermistor 50 detects the temperature of ink contained in the ink cartridge 61 (see FIG. 1). Analog data of the detected temperature or an output voltage from the inductor 45 is converted into digital data by the A/D converter 36.

The serial control circuit 37 is connected to a register 40 through a clock signal line CLK, a data signal line DATA, and a strobe signal line STB. The PWM control circuit 38 is connected to a DC/DC control circuit 41 through a D/A converter 39. A PWM signal, serving as a reference voltage, generated by the PWM control circuit 38 is converted into an analog signal by the D/A converter 39 and is then output to the DC/DC control circuit 41. Then, the DC/DC control circuit 41 generates a voltage to be output to a head driver 47 on the basis of the reference voltage. The ROM 33 stores a printing control program 33*a* for executing a printing process shown in FIG. 3. The EEPROM 35 stores a table having the relationship between the ink temperature and the head voltage shown in FIG. 4 recorded therein.

The register 40 and the DC/DC control circuit 41 are realized on the single complex IC 20. The DC/DC control circuit 41 generates a switching signal for converting a DC voltage input from a main power supply into another DC voltage, and is connected to a gate of a MOS-FET 42 (hereinafter, referred to as an 'internal MOS 42') on the complex IC 20 and a gate of a MOS-FET 43 (hereinafter, referred to as an 'external MOS 43') attached outside the complex IC 20. Sources of the internal MOS 42 and the external MOS 43 are connected to a main power supply 48 through a resistor 51. A drain of the internal MOS 42 and a drain of the external MOS 43 are connected to the head driver 47 through the inductor 45. A diode 44 is connected to an input terminal of the inductor 45, and a capacitor 46 is connected to an output terminal of the inductor 45. A comparator 53 is connected between the input and output terminals of the resistor 51 to detect an overcurrent. The comparator 53 compares the power supply voltage supplied from main power supply 48 to the input terminal of the resistor 51 with the voltage at the output terminal of the resistor 51. If an overcurrent is detected then an overcurrent detection signal is sent to the I/O port 30 of the ASIC 21, which passes the signal on to the CPU 32. In response to the overcurrent detection signal, the CPU 32 sends a control signal via the serial control circuit 37 to the register 40, which generates and transmits an OFF signal to the DC/DC converter 41 to turn off the internal MOS 42 and the external MOS 43. In an alternative aspect, the overcurrent detection signal may be sent directly to the register 40, which can generate and transmit an OFF signal to the DC/DC converter 41 to turn off the internal MOS 42 and the external MOS 43.

The DC/DC control circuit 41, the internal MOS 42 (first switch), the external MOS 43 (second switch), the resistor 51, the comparator 53 for detecting an overcurrent, the inductor 45, the diode 44, and the capacitor 46 form a step-down switching DC/DC converter. A DC voltage of the main power supply 48 is converted into another DC voltage by the step-down switching DC/DC converter and is then output to the head driver 47.

The DC/DC control circuit 41 is connected to the register 40, and includes a mode switch (not shown) that performs switching based on the serial signal transmitted from the register 40. The output of the switching signal generated by the DC/DC control circuit 41 to the internal MOS 42 or the external MOS 43 is determined by the switching operation of the mode switch.

In this structure, the internal MOS 42 and the external MOS 43 are connected to the common resistor 51, which makes it possible to use a common part and thus to reduce manufacturing costs even when two switching elements, that is, the internal MOS 42 and the external MOS 43, are provided. In addition, the common resistor 51 is attached outside the complex IC 20 that has the internal MOS 42 thereon and is coated with a metallic material, which makes it possible to for the comparator 53 to detect an overcurrent more accurately than a structure in which a common resistor and comparator are formed of a semiconductor and is realized on the complex IC 20.

Figure 3:
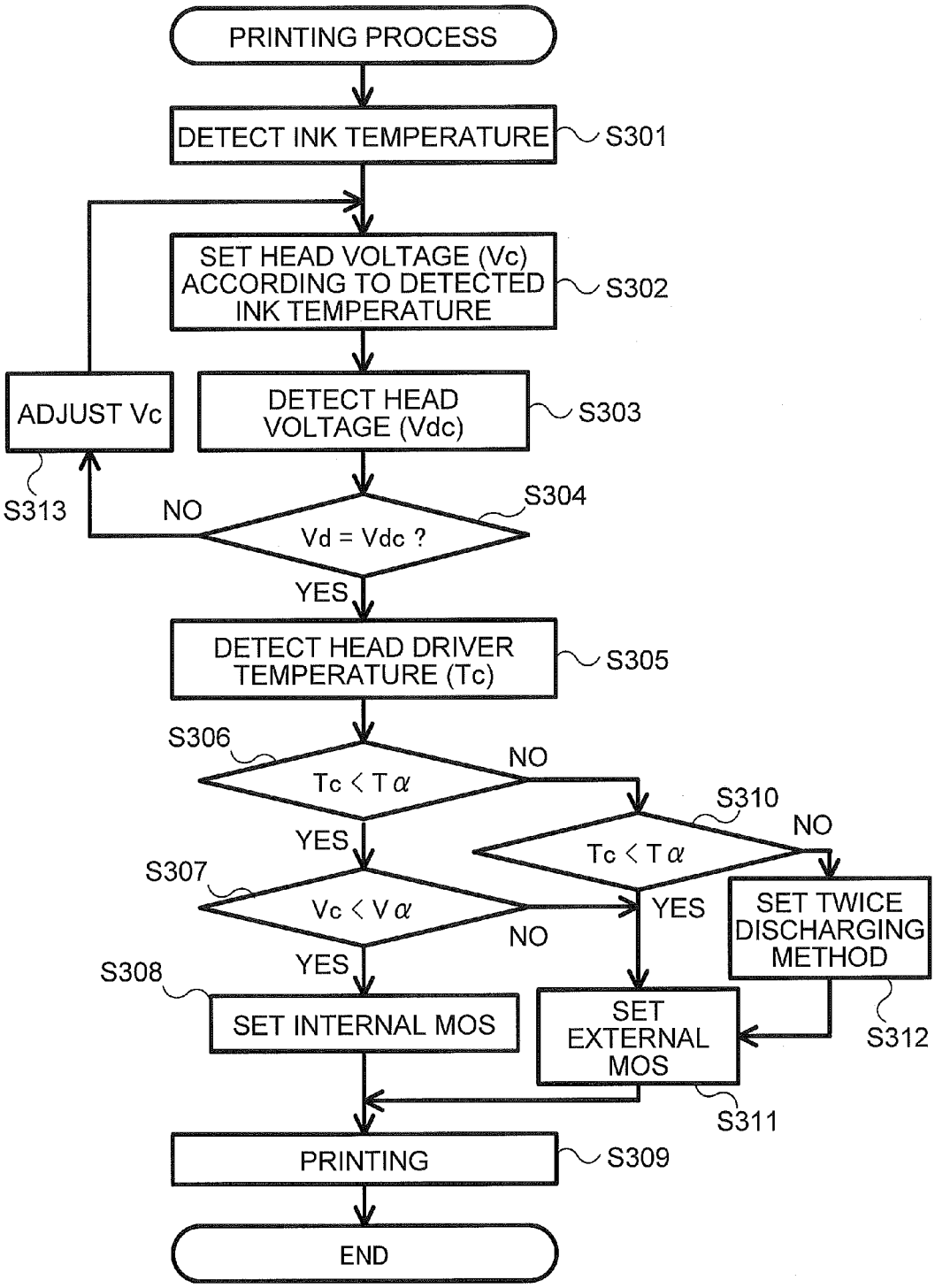
FIG. 3 is a flowchart illustrating a printing process.
Figure 4:
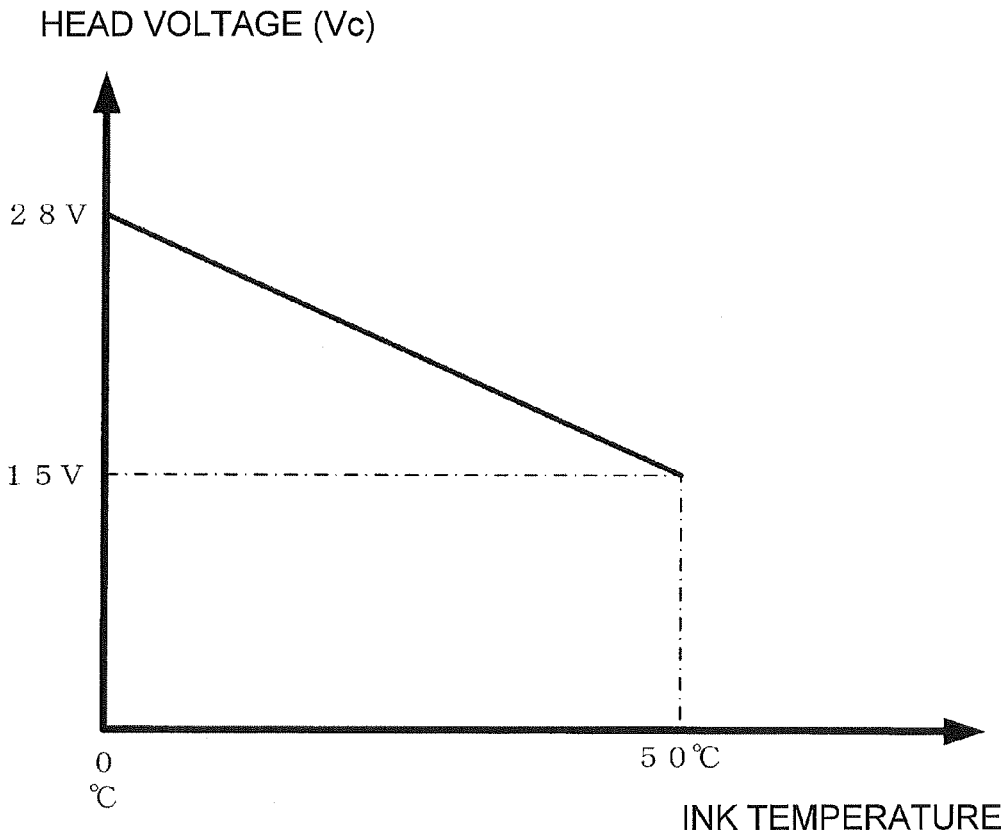
FIG. 4 is a graph illustrating a head voltage set according to the temperature of ink.

Next, a printing process will be described with reference to FIG. 3. FIG. 3 is a flowchart illustrating the printing process. In the printing process, the output of the switching signal to the internal MOS 42 or the external MOS 43 is determined to perform printing. The printing process is performed by the CPU 32 according to the printing control program 33*a* stored in the ROM 33.

In the printing process, first, the ink temperature detecting thermistor 50 detects the temperature of ink (S301), and a head voltage Vc is set according to the detected ink temperature (S302). For example, the relationship between the temperature of ink and the head voltage Vc is that shown in FIG. 4. That is, as the temperature of ink increases, the head voltage Vc is lowered.

When the head voltage Vc is set, the actual head voltage Vdc is detected (S303). Then, it is determined whether the detected head voltage Vdc is equal to the head voltage Vc set in step S302 (S304). When the head voltage Vdc is not equal to the head voltage Vc (S304: No), the head voltage Vc set in step S302 is adjusted (S313). Then, the process is repeated from step S302.

On the other hand, when the detected head voltage Vdc is equal to the head voltage Vc set in step S302 (S304: Yes), the head driver temperature detecting thermistor 49 detects the temperature Tc of the head driver 47 (S305). It is determined whether the temperature Tc of the head driver 47 is less than a predetermined threshold value Tα (for example, 60° C.) (S306). When the temperature Tc of the head driver 47 is less than the predetermined threshold value Tα (S306: Yes), it is determined whether the head voltage Vc set in step S302 is less than a predetermined threshold value Vα (for example, 20 V) (S307). When the head voltage Vc is less than the predetermined threshold value Vα (S307: Yes), the switching element outputting the switching signal is set as the internal MOS 42 (S308), and printing is performed (S309). In this way, the printing process is completed.

It an alternative aspect S307 may be omitted from the process in FIG. 3, such that if the temperature Tc is less than the predetermined threshold temperature Tα, then control can proceed directly from S306 to S308. In still another alternative aspect, S306, S310 and S312 may be omitted such that after S305, control proceeds directly to S307.

That is, when the temperature Tc of the head driver 47 is less than the predetermined threshold value Tα, the switching signal is output to the internal MOS 42. The structure in which the internal MOS 42 performs the switching operation has a higher response performance than the structure in which the external MOS 43 performs the switching operation. Therefore, when the internal MOS 42 performs the switching operation, it is possible to improve the driving efficiency.

When the head voltage Vc set in step S302 is less than the predetermined threshold value Vα, the switching signal is output to the internal MOS 42. When the head voltage Vc is less than the predetermined threshold value Vα, power consumption and the amount of heat generated are reduced. Therefore, the structure in which the internal MOS 42 performs the switching operation has a higher response performance than the structure in which the external MOS 43 performs the switching operation. Thus, when the internal MOS 42 performs the switching operation, it is possible to improve the driving efficiency.

On the other hand, in step S306, when the temperature Tc of the head driver 47 is not less than the predetermined threshold value Tα (S306: No), it is determined whether the temperature Tc of the head driver 47 is less than a predetermined threshold value Tβ (for example, 90° C.) that is greater than the predetermined threshold value Tα (S310). When it is determined that the temperature Tc of the head driver 47 is less than the predetermined threshold value Tβ (S310: Yes), the switching element outputting the switching signal is set as the external MOS 43 (S311), and printing is performed (S309). In this way, the printing process is completed.

That is, when the temperature Tc of the head driver 47 is greater than the predetermined threshold value Tα, the switching signal is output to the external MOS 43. When the temperature Tc of the head driver 47 is greater than the predetermined threshold value Tα, the external MOS 43 performs the switching operation, which makes it possible to increase the amount of heat dissipated and prevent an increase in temperature due to the generation of heat.

When it is determined in step S310 that the temperature Tc of the head driver 47 is not less than the predetermined threshold value Tβ (S310: No), a method of discharging ink slower, for example twice as long as the normal discharge period, is set as an ink discharging method (S312). Then, the switching element outputting the switching signal is set as the external MOS 43 (S311), and printing is performed (S309). In this way, the printing process is completed.

That is, when it is determined that the temperature Tc of the head driver 47 is not less than the predetermined threshold value Tβ, the method of discharging ink at a slower rate for one line is set as an ink discharging method. The method of discharging ink slower (e.g., twice as along as the regular or standard discharge method) to print one line generates a smaller amount of heat than a method of discharging ink at the standard rate to print one line, and thus can prevent an increase in temperature due to the generation of heat.

When it is determined in step S307 that the head voltage Vc set in step S302 is not less than the predetermined threshold value Vα (S307: No), the switching element outputting the switching signal is set as the external MOS 43 (S311), and printing is performed (S309). In this way, the printing process is completed.

That is, when the head voltage Vc set in step S302 is not less than the predetermined threshold value Vα, the switching signal is output to the external MOS 43. When the head voltage Vc set in step S302 is greater than the predetermined threshold value Vα, power consumption and the amount of heat generated increase. Therefore, the structure in which the external MOS 43 performs the switching operation dissipates a larger amount of heat than the structure in which the internal MOS 42 performs the switching operation. Thus, when the external MOS 43 performs the switching operation, it is possible to prevent an increase in temperature due to the generation of heat.

Although the exemplary aspects of the invention have been described above, the invention is not limited thereto. For example, various modifications and changes the invention can be made without departing from the scope and spirit of the invention.

For example, in the above-described aspects, the use of the internal MOS 42 or the external MOS 43 depends on the set head voltage Vc, but the invention is not limited thereto. For example, the following structure may be used: environmental temperature (for example, outdoor air temperature, temperature in an apparatus, and ink temperature) is measured, and the use of the internal MOS 42 or the external MOS 43 is determined on the basis of the measured environmental temperature. For example, when the environmental temperature is greater than a predetermined threshold temperature, the internal MOS 42 may be used. On the other hand, when environmental temperature is less than the predetermined threshold temperature, the external MOS 43 may be used.

In this case, when the environmental temperature is not less than the predetermined threshold temperature, power consumption and the amount of heat generated decrease. Therefore, the structure in which the first switch performs the switching operation has a higher response performance than the structure in which the second switch performs the switching operation. Thus, when the first switch performs the switching operation, it is possible to improve the driving efficiency. On the other hand, when the environmental temperature is less than the predetermined threshold temperature, power consumption and the amount of heat generated increase. Therefore, the structure in which the second switch performs the switching operation can dissipate a larger amount of heat than the structure in which the first switch performs the switching operation, and thus can prevent an increase in temperature due to the generation of heat.

What is claimed is:

1. A recording apparatus comprising:

a head that discharges ink;

a head driving circuit that drives the head;

a switching signal generating unit that generates and outputs a switching signal;

a first switch that is turned on or off based on the switching signal;

a second switch that is turned on or off based on the switching signal, wherein a first DC voltage is converted into a second DC voltage by turning on one of the first switch and the second switch based on the switching signal, and the turned on one of the first switch and the second switch supplying the second DC voltage to the head driving circuit;

a temperature detector that detects a temperature of the head or a temperature of the ink in the head; and a controller that controls the switching signal generating unit to generate the switching signal, wherein the controller controls the switching signal generating unit to output the switching signal to the first switch when the detected temperature is less than a first predetermined temperature and to output the switching signal to the second switch when the detected temperature is equal to or greater than the first predetermined temperature, wherein the first switch and the switching signal generating unit are realized on a single integrated circuit chip, and the second switch is attached external to the integrated circuit chip having the first switch thereon.

2. The recording apparatus according to claim 1, further comprising:

a common current detector external to the integrated circuit chip that detects a current flowing through the first switch and the second switch, wherein when an overcurrent is detected the switching signal generating circuit generates the switching signal to turn OFF the first and second switches.

3. The recording apparatus according to claim 2, wherein the common current detector sends the overcurrent detection signal to the controller.

4. The recording apparatus according to claim 1, wherein the temperature detector detects the temperature of the head driving circuit.

5. The recording apparatus according to claim 1, wherein the temperature detector detects the temperature of ink in the head.

6. The recording apparatus according to claim 1, wherein at least one of the first switch and the second switch is a MOS.

7. The recording apparatus according to claim 1, wherein the controller controls the switching signal generating unit to output the switching signal, the switching signal causing the second DC voltage to be supplied to the head driving circuit to drive the head to discharge the ink at a slower rate when the detected temperature is equal to or greater than a second predetermined temperature that is greater than the first predetermined temperature.

8. A method for controlling discharge of ink from a head in a recording apparatus comprising the steps of:

detecting temperature of the head or ink in the head;

generating a first switching signal by a switching signal generating unit when the detected temperature is less than a first predetermined temperature;

generating a second switching signal by the switching signal generating unit when the detected temperature is equal to or greater than the first predetermined temperature;

converting a first DC voltage into a second DC voltage by turning on one of a first switch realized on a single integrated circuit chip with the switching signal generating unit in response to the generation of the first switching signal and a second switch attached external to the integrated circuit chip having the first switch thereon in response to the generation of the second switching signal; and supplying the second DC voltage from the turned on one of the first switch and the second switch to a head driving circuit which drives the head to discharge ink.

9. The method of claim 8, further comprising the step of supplying the second DC voltage to the head driving circuit to drive the head to discharge the ink at a slower rate when the detected temperature is equal to or greater than a second predetermined temperature that is greater than the first predetermined temperature.

* * * * *